US010385541B2

(12) United States Patent
Dean

(10) Patent No.: US 10,385,541 B2
(45) Date of Patent: Aug. 20, 2019

(54) WORK VEHICLE WITH IMPROVED LOADER/IMPLEMENT RETURN POSITION CONTROL

(71) Applicant: CNH Industrial America, LLC, New Holland, PA (US)

(72) Inventor: Patrick Thomas Dean, Chicago, IL (US)

(73) Assignee: CNH Industrial America LLC, New Holland, PA (US)

( * ) Notice: Subject to any disclaimer, the term of this patent is extended or adjusted under 35 U.S.C. 154(b) by 98 days.

(21) Appl. No.: 15/438,910

(22) Filed: Feb. 22, 2017

(65) Prior Publication Data

US 2018/0238023 A1 Aug. 23, 2018

(51) Int. Cl.
*E02F 9/20* (2006.01)
*E02F 3/43* (2006.01)

(52) U.S. Cl.
CPC ..... *E02F 9/2033* (2013.01); *E02F 3/433* (2013.01); *E02F 3/434* (2013.01)

(58) Field of Classification Search
None
See application file for complete search history.

(56) References Cited

U.S. PATENT DOCUMENTS 6,374,147 B1 4/2002 Rockwood
7,530,185 B2 5/2009 Trifunovic
8,244,438 B2 8/2012 Koch et al.
8,527,158 B2 9/2013 Faivre et al.
2005/0073140 A1* 4/2005 Boucher ..... B60R 21/131 280/756
2012/0101693 A1 4/2012 Taylor
2012/0263566 A1 10/2012 Taylor et al.
2013/0108403 A1 5/2013 Atkinson
2016/0108602 A1* 4/2016 Singh ..... E02F 3/434 701/50
2016/0153165 A1* 6/2016 Singh ..... E02F 9/2029 701/50
2017/0036899 A1* 2/2017 Singh ..... B66F 9/22

FOREIGN PATENT DOCUMENTS

WO WO 2013057758 4/2013

* cited by examiner

*Primary Examiner* — Thomas G Black
*Assistant Examiner* — Demetra R Smith-Stewart
(74) *Attorney, Agent, or Firm* — Peter K. Zacharias; Patrick M. Sheldrake

(57) ABSTRACT

The present disclosure is directed to a control method for controlling the operation of a lift assembly of a work vehicle, wherein the lift assembly includes an implement and at least one loader arm coupled to the implement. As such, the method may generally include transmitting at least one first command signal in order to simultaneously move the loader arm and the implement towards a return position. The first command signal(s) are associated with moving the loader arms at a movement velocity. The method also includes monitoring a height of the implement relative to a driving surface of the work vehicle during simultaneous movement of the loader arm and the implement. As such, the method may also include reducing the movement velocity of the loader arm when the height is below a predetermined threshold.

15 Claims, 5 Drawing Sheets

WORK VEHICLE WITH IMPROVED LOADER/IMPLEMENT RETURN POSITION CONTROL

FIELD OF THE INVENTION

The present disclosure relates generally to work vehicles and, more particularly, to a system and method for controlling the operation of a vehicle's lift assembly to allow the loader arms and the implement to be moved to a return position simultaneously without the implement impacting the ground.

BACKGROUND OF THE INVENTION

Work vehicles having lift assemblies, such as skid steer loaders, telescopic handlers, wheel loaders, backhoe loaders, forklifts, compact track loaders and the like, are a mainstay of construction work and industry. For example, skid steer loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arm, which allows the skid steer loader to be used to carry supplies or particulate matter, such as gravel, sand, or dirt, around a worksite.

Control systems have been disclosed in the past having optional features that allows the operator to reset the loader arm(s) or implement to a travel height (i.e. near the ground level) and the implement to a dig orientation (i.e. with the teeth pointing forward) automatically via, e.g. joystick action or button press. Other times, the operator completes these actions simultaneously.

Unfortunately, when the operator executes such actions simultaneously, the implement circuit can occasionally impact the ground due to the implement function performing its operation too quickly. Generally, such impact occurs only when the implement is close to the ground, thereby not allowing the implement circuit enough time to accomplish its automated movement before the implement reaches a height at which the implement no longer has clearance between itself and the ground.

Accordingly, an improved system and method for controlling the operation of a vehicle's lift assembly to allow the loader arms and the implement to be moved to a return position simultaneously without the implement impacting the ground would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present disclosure is directed to a method for controlling the operation of a lift assembly of a work vehicle, wherein the lift assembly includes an implement and at least one loader arm coupled to the implement. The method may generally include transmitting, with a computing device, at least one first command signal in order to simultaneously move the loader arm and the implement towards a return position. The first command signal(s) are associated with moving the loader arms at a movement velocity. The method also includes monitoring, with the computing device, a height of the implement relative to a driving surface of the work vehicle during simultaneous movement of the loader arm and the implement. Further, the method includes reducing the movement velocity of the loader arm when the height of the implement is below a predetermined threshold so as to prevent the implement from impacting the driving surface.

In another aspect, the present disclosure is directed to a control system for operating a lift assembly of a work vehicle, wherein the lift assembly includes an implement and at least one loader arm coupled to the implement. The control system may generally include one or more sensors configured to monitor a height of the implement and a controller communicatively coupled to the sensors. Further, the controller includes one or more processors configured to perform one or more operations, including but not limited to transmitting at least one first command signal in order to simultaneously move the loader arm and the implement towards a return position, the at least one first command signal associated with moving the loader arms at a movement velocity, receiving the height of the implement relative to a driving surface of the work vehicle during simultaneous movement of the loader arm and the implement, and reducing the movement velocity of the loader arm when the height of the implement is below a predetermined threshold so as to prevent the implement from impacting the driving surface.

In yet another aspect, the present disclosure is directed to a method for controlling the operation of a lift assembly of a work vehicle, wherein the lift assembly includes an implement and at least one loader arm coupled to the implement. The method may generally include receiving, with a computing device, an input associated with an instruction to move the loader arm and the implement to a return position. The method also includes transmitting, with the computing device, at least one first command signal in order to simultaneously move the loader arm and the implement towards the return position, the at least one first command signal associated with moving the loader arms at a movement velocity. Further, the method includes monitoring, with the computing device, a height of the implement relative to a reference location during simultaneous movement of the loader arm and the implement. Moreover, the method includes transmitting, with the computing device, at least one second command signal in order to ramp down the movement velocity of the loader arm when the height of the implement is below a predetermined threshold so as to prevent the implement from impacting the driving surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
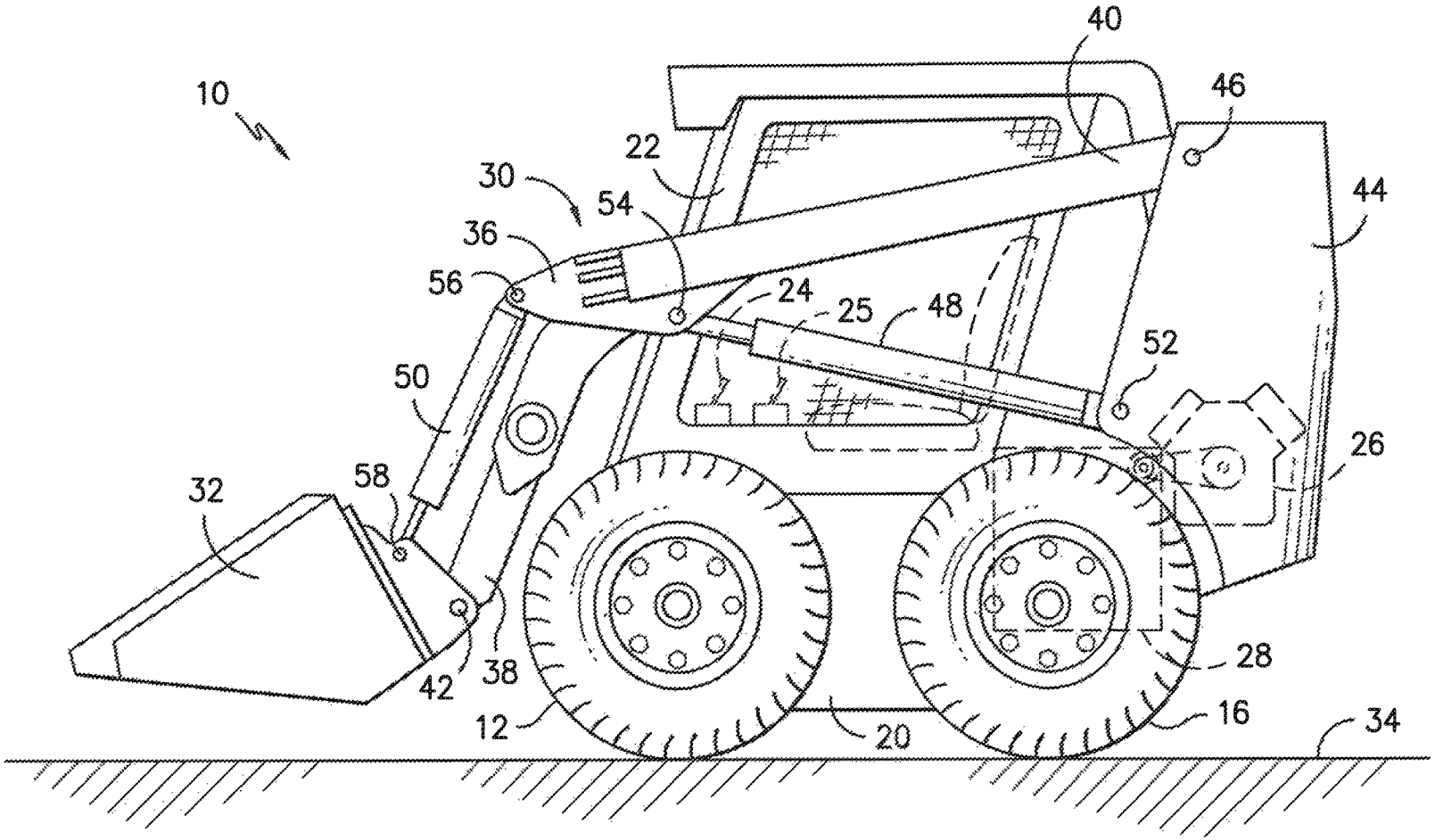
FIG. 1 illustrates a side view of one embodiment of a work vehicle according to the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 illustrates a side view of one embodiment of a work vehicle 10 in accordance with aspects of the present disclosure. As shown, the work vehicle 10 is configured as a skid steer loader. However, in other embodiments, the work vehicle 10 may be configured as any other suitable work vehicle known in the art, such as any other vehicle including a lift assembly that allows for the maneuvering of an implement (e.g., telescopic handlers, wheel loaders, backhoe loaders, forklifts, compact track loaders, bulldozers and/or the like).

As shown, the work vehicle 10 includes a pair of front wheels 12, (one of which is shown), a pair of rear wheels 16 (one of which is shown) and a chassis 20 coupled to and supported by the wheels 12, 16. An operator's cab 22 may be supported by a portion of the chassis 20 and may house various input devices, such as one or more speed control joystick(s) 24 and one or more lift tilt joystick(s) 25, for permitting an operator to control the operation of the work vehicle 10. In addition, the work vehicle 10 may include an engine 26 and a hydrostatic drive unit 28 coupled to or otherwise supported by the chassis 20.

Moreover, as shown in FIG. 1, the work vehicle 10 may also include a lift assembly 30 for raising and lowering a suitable implement 32 (e.g., a bucket) relative to a driving surface 34 of the vehicle 10. In several embodiments, the lift assembly 30 may include at least one loader arm (such as a pair of loader arm(s)) 36 (one of which is shown) pivotally coupled between the chassis 20 and the implement 32. For example, as shown in illustrated embodiment of FIG. 1, each loader arm 36 may be configured to extend lengthwise between a forward end 38 and an aft end 40, with the forward end 38 being pivotally coupled to the implement 32 at a forward pivot point 42 and the aft end 40 being pivotally coupled to the chassis 20 (or a rear tower(s) 44 coupled to or otherwise supported by the chassis 20) at a rear pivot point 46.

In addition, the lift assembly 30 may also include a pair of hydraulic lift cylinders 48 coupled between the chassis 20 (e.g., at the rear tower(s) 44) and the loader arm(s) 36 and a pair of hydraulic tilt cylinders 50 coupled between the loader arm(s) 36 and the implement 32. For example, as shown in the illustrated embodiment, each lift cylinder 48 may be pivotally coupled to the chassis 20 at a lift pivot point 52 and may extend outwardly therefrom so to be coupled to its corresponding loader arm 36 at an intermediate attachment location 54 defined between the forward and aft ends 38, 40 of each loader arm 36. Similarly, each tilt cylinder 50 may be coupled to its corresponding loader arm 36 at a first attachment location 56 and may extend outwardly therefrom so as to be coupled to the implement 32 at a second attachment location 58.

It should be readily understood by those of ordinary skill in the art that the lift and tilt cylinders 48, 50 may be utilized to allow the implement 32 to be raised/lowered and/or pivoted relative to the driving surface 34 of the work vehicle 10. For example, the lift cylinders 48 may be extended and retracted in order to pivot the loader arm(s) 36 upward and downwards, respectively, about the rear pivot point 52, thereby at least partially controlling the vertical positioning of the implement 32 relative to the driving surface 34. Similarly, the tilt cylinders 50 may be extended and retracted in order to pivot the implement 32 relative to the loader arm(s) 36 about the forward pivot point 42, thereby controlling the tilt angle or orientation of the implement 32 relative to the driving surface 34. As will be described below, such control of the positioning and/or orientation of the various components of the lift assembly 30 may allow for the loader arm(s) 36 and/or the implement 32 to be moved to one or more pre-defined positions, such as a return position, during operation of the work vehicle 10.

It should be appreciated that the configuration of the work vehicle 10 described above and shown in FIG. 1 is provided only to place the present disclosure in an exemplary field of use. Thus, it should be appreciated that the present disclosure may be readily adaptable to any manner of work vehicle configuration.

Figure 2:
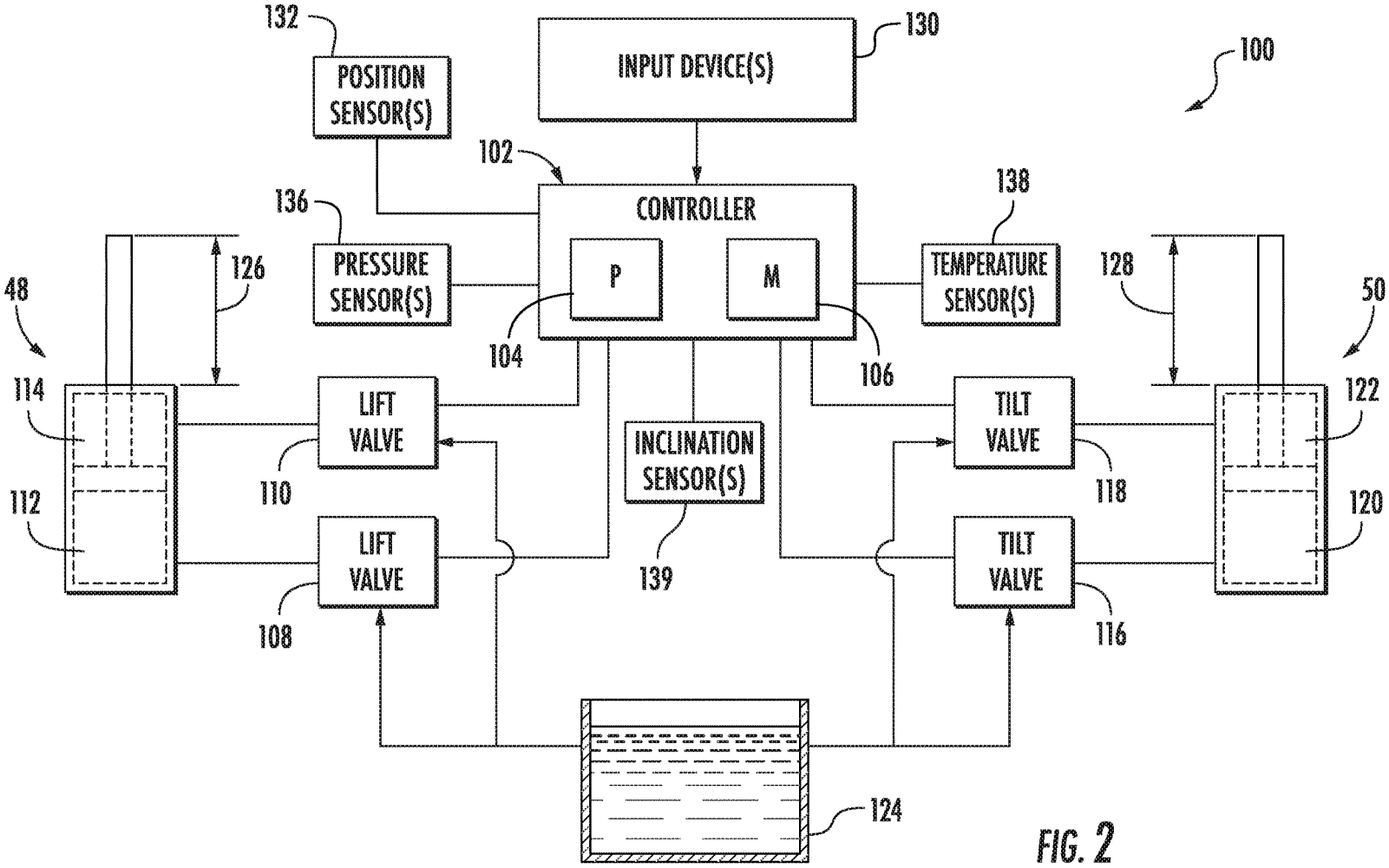
FIG. 2 illustrates a schematic view of one embodiment of a suitable control system for controlling various components of a work vehicle in accordance with aspects of the present disclosure, particularly illustrating the control system configured for controlling various hydraulic components of the work vehicle, such as the valves and associated hydraulic cylinders of the work vehicle.

Referring now to FIG. 2, one embodiment of a control system 100 suitable for controlling the various lift assembly components of a work vehicle is illustrated in accordance with aspects of the present disclosure. In general, the control system 100 will be described herein with reference to the work vehicle 10 described above with reference to FIG. 1. However, it should be appreciated by those of ordinary skill in the art that the disclosed system 100 may generally be utilized to the control the lift assembly components of any suitable work vehicle.

As shown, the control system 100 may generally include a controller 102 configured to electronically control the operation of one or more components of the work vehicle 10, such as the various hydraulic components of the work vehicle 10 (e.g., the lift cylinders 48 and/or the tilt cylinders 50). In general, the controller 102 may comprise any suitable processor-based device known in the art, such as a computing device or any suitable combination of computing devices. Thus, in several embodiments, the controller 102 may include one or more processor(s) 104 (indicated as "P" in FIG. 2) and associated memory device(s) 106 (indicated as "M" in FIG. 2) configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the algorithms or methods described below with reference to FIG. 5. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 48, 50 of the work vehicle 10. For example, the controller 102 may be communicatively coupled to suitable valves 108, 110 (e.g., solenoid-activated valves) configured to control the supply of hydraulic fluid to each lift cylinder 48 (only one of which is shown in FIG. 2). Specifically, as shown in the illustrated embodiment, the system 100 may include a first lift valve 108 for regulating the supply of hydraulic fluid to a cap end 112 of each lift cylinder 48. In addition, the system 100 may include a second lift valve 110 for regulating the supply of hydraulic fluid to a rod end 114 of each lift cylinder 48. Moreover, the controller 102 may be communicatively coupled to suitable valves 116, 118 (e.g., solenoid-activated valves) configured to regulate the supply of hydraulic fluid to each tilt cylinder 50 (only one of which is shown in FIG. 2). For example, as shown in the illustrated embodiment, the system 100 may include a first tilt valve 116 for regulating the supply of hydraulic fluid to a cap end 120 of each tilt cylinder 50 and a second tilt valve 118 for regulating the supply of hydraulic fluid to a rod end 122 of each tilt cylinder 50.

During operation, the controller 102 may be configured to control the operation of each valve 108, 110, 116, 118 in order to control the flow of hydraulic fluid supplied to each of the cylinders 48, 50 from a suitable hydraulic tank 124 of the work vehicle 10 (e.g., via a hydraulic pump). For instance, the controller 102 may be configured to transmit suitable control commands to the lift valves 108, 110 in order to regulate the flow of hydraulic fluid supplied to the cap and rod ends 112, 114 of each lift cylinder 48, thereby allowing for control of a stroke length 126 of the piston rod associated with each cylinder 48. Of course, similar control commands may be transmitted from the controller 102 to the tilt valves 116, 118 in order to control a stroke length 128 of the tilt cylinders 50. Thus, by carefully controlling the actuation or stroke length 126, 128 of the lift and tilt cylinders 48, 50, the controller 102 may, in turn, be configured to control the manner in which the loader arm(s) 36 and the implement 32 are positioned or oriented relative to the vehicle's driving surface 34 and/or relative to any other suitable reference point.

Additionally, in several embodiments, the controller 102 may be configured to store information associated with one or more pre-defined position settings for the loader arm(s) 36 and/or the implement 32. For example, one or more pre-defined position settings may be stored for the loader arm(s) 36, such as a first loader position setting at which the forward pivot point 42 is located at a first height from the vehicle's driving surface 34 (e.g., a return-to-travel position) and a second loader position setting at which the forward pivot point 42 is located at a greater, second height from the vehicle's driving surface 34 (e.g., a return-to-height position). Similarly, one or more pre-defined defined position settings may be stored for the implement 32, such as a first implement position setting at which the implement 32 is located at a given angular position or orientation relative to the vehicle's driving surface 34 (e.g., a return-to-dig position) and a second implement position setting at which the implement 32 is located at a different angular position or orientation relative to the vehicle's driving surface 34 (e.g., a return-to-dump position). In such embodiments, the various predefined position settings stored within the controller's memory 106 may correspond to pre-programmed factory settings and/or operator defined position settings. For instance, as will be described below, the operator may provide a suitable input instructing the controller 102 to learn or record a position setting for the loader arm(s) 36 and/or the implement 32 based on the current position of such lift assembly component(s).

It should be appreciated that the current commands provided by the controller 102 to the various valves 108, 110, 116, 118 may be in response to inputs provided by the operator via one or more input devices 130. For example, one or more input devices 130 (e.g., the joystick(s) 25 shown in FIG. 1) may be provided within the cab 22 to allow the operator to provide operator inputs associated with controlling the position of the loader arm(s) 36 and the implement 32 relative to the vehicle's driving surface 34 (e.g., by varying the current commands supplied to the lift and/or tilt valves 108, 110, 116, 118 based on operator-initiated changes in the position of the lift/tilt joystick(s) 25). Alternatively, the current commands provided to the various valves 108, 110, 116, 118 may be generated automatically based on a control algorithm implemented by the controller 102. For instance, as will be described in detail below, the controller 102 may be configured to implement an algorithm for simultaneously moving the loader arm(s) 36 and/or the implement 32 to a return position (i.e. simultaneously moving the loader arm(s) 36 to the return-to-travel position and the implement 32 to the return-to-dig position). In such instance, upon selection by the operator of the return position, control commands may be automatically generated by the controller 102 via implementation of one of the control algorithms and subsequently transmitted to the lift valve(s) 108, 110 and/or the tilt valve(s) 116, 118 to provide for control of the velocity and/or the position of the loader arm(s) 36 and/or the implement 32 as such component(s) is moved to the return position.

Additionally, it should be appreciated that the work vehicle 10 may also include any other suitable input devices 130 for providing operator inputs to the controller 102. For instance, the operator may be allowed to position the loader arm(s) 36 and/or the implement 32 at the desired position(s) via a suitable input device 130 (e.g., a button or switch).

Moreover, as shown in FIG. 2, the controller 102 may also be communicatively coupled to one or more position sensors 132 for monitoring the position(s) and/or orientation(s) of the loader arm(s) 36 and/or the implement 32. In several embodiments, the position sensor(s) 132 may correspond to one or more angle sensors (e.g., a rotary or shaft encoder(s) or any other suitable angle transducer) configured to monitor the angle or orientation of the loader arm(s) 36 and/or implement 32 relative to one or more reference points. For instance, in one embodiment, an angle sensor(s) may be positioned at the forward pivot point 42 (FIG. 1) to allow the angle of the implement 32 relative to the loader arm(s) 36 to be monitored. Similarly, an angle sensor(s) may be positioned at the rear pivot point 46 to allow the angle of the loader arm(s) 36 relative to a given reference point on the work vehicle 10 to be monitored. In addition to such angle sensor(s), or as an alternative thereto, one or more secondary angle sensors (e.g., a gyroscope, inertial sensor, etc.) may be mounted to the loader arm(s) 36 and/or the implement 32 to allow the orientation of such component(s) relative to the vehicle's driving surface 34 to be monitored.

In other embodiments, the position sensor(s) 132 may correspond to any other suitable sensor(s) that is configured to provide a measurement signal associated with the position and/or orientation of the loader arm(s) 36 and/or the implement 32. For instance, the position sensor(s) 132 may correspond to one or more linear position sensors and/or encoders associated with and/or coupled to the piston rod(s) or other movable components of the cylinders 48, 50 in order to monitor the travel distance of such components, thereby allowing for the position of the loader arm(s) 36 and/or the implement 32 to be calculated. Alternatively, the position sensor(s) 132 may correspond to one or more non-contact sensors, such as one or more proximity sensors, configured to monitor the change in position of such movable components of the cylinders 48, 50. In another embodiment, the position sensor(s) 132 may correspond to one or more flow sensors configured to monitor the fluid into and/or out of each cylinder 48, 50, thereby providing an indication of the degree of actuation of such cylinders 48, 50 and, thus, the location of the corresponding loader arm(s) 36 and/or implement 32. In a further embodiment, the position sensor(s) 132 may correspond to a transmitter(s) configured to be coupled to a portion of one or both of the loader arm(s) 36 and/or the implement 32 that transmits a signal indicative of the height/position and/or orientation of the loader arms/implement 36, 32 to a receiver disposed at another location on the vehicle 10.

It should be appreciated that, although the various sensor types were described above individually, the work vehicle 10 may be equipped with any combination of position sensors 132 and/or any associated sensors that allow for the position and/or orientation of the loader arm(s) 36 and/or the implement 32 to be accurately monitored. For instance, in one embodiment, the work vehicle 10 may include both a first set of position sensors 132 (e.g., angle sensors) associated with the pins located at the pivot joints defined at the forward and rear pivot points 42, 46 for monitoring the relative angular positions of the loader arm(s) 36 and the implement 32 and a second set of position sensors 132 (e.g., a linear position sensor(s), flow sensor(s), etc.) associated with the lift and tilt cylinders 48, 50 for monitoring the actuation of such cylinders 48, 50.

Moreover, it should be appreciated that the controller 102 may be coupled to various other sensors for monitoring one or more other operating parameters of the work vehicle 10. For instance, as shown in FIG. 2, the controller may be coupled to one or more pressure sensors 136 for monitoring the hydraulic pressure supplied within the lift and/or tilt cylinders 48, 50. In such an embodiment, the pressure sensor(s) 136 may, for example, allow the controller 102 to monitor the pressure of the hydraulic fluid supplied to both rod and cap ends 112, 114, 120, 112 of each of the various hydraulic cylinders 48, 50 of the lift assembly 30. Additionally, as shown in FIG. 2, the controller 102 may also be coupled to one or more temperature sensors 138 for monitoring the temperature of the hydraulic fluid within the system 100 and/or one or more tilt or inclination sensors 139 for monitoring the angle of inclination of the work vehicle 10 relative to a horizontal plane extending perpendicular to the direction of the gravitational three acting on the vehicle 10.

Figure 3:
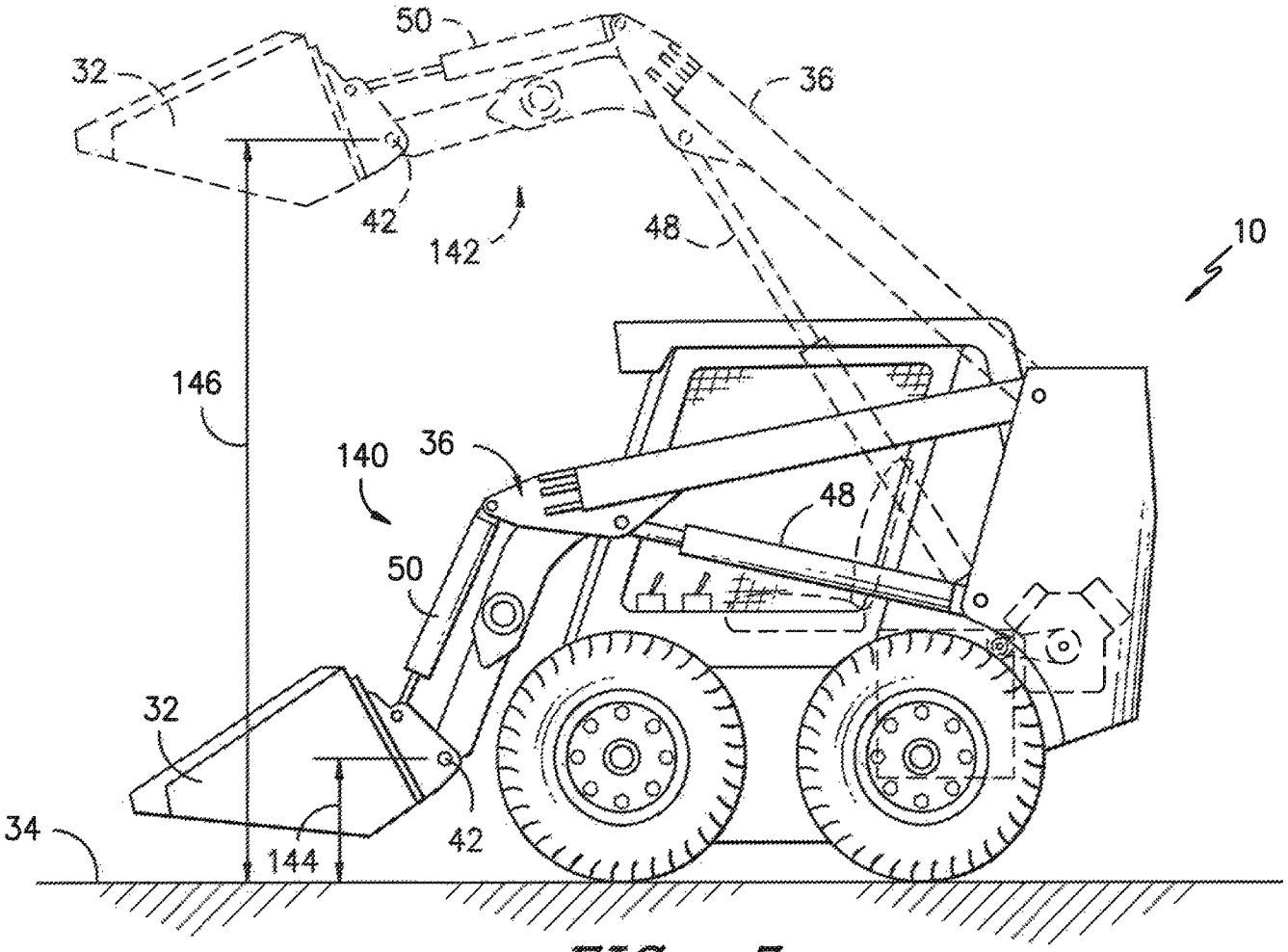
FIG. 3 illustrates another side view of the work vehicle shown in FIG. 1, particularly illustrating two different pre-defined positons for the vehicle's loader arms.
Figure 4:
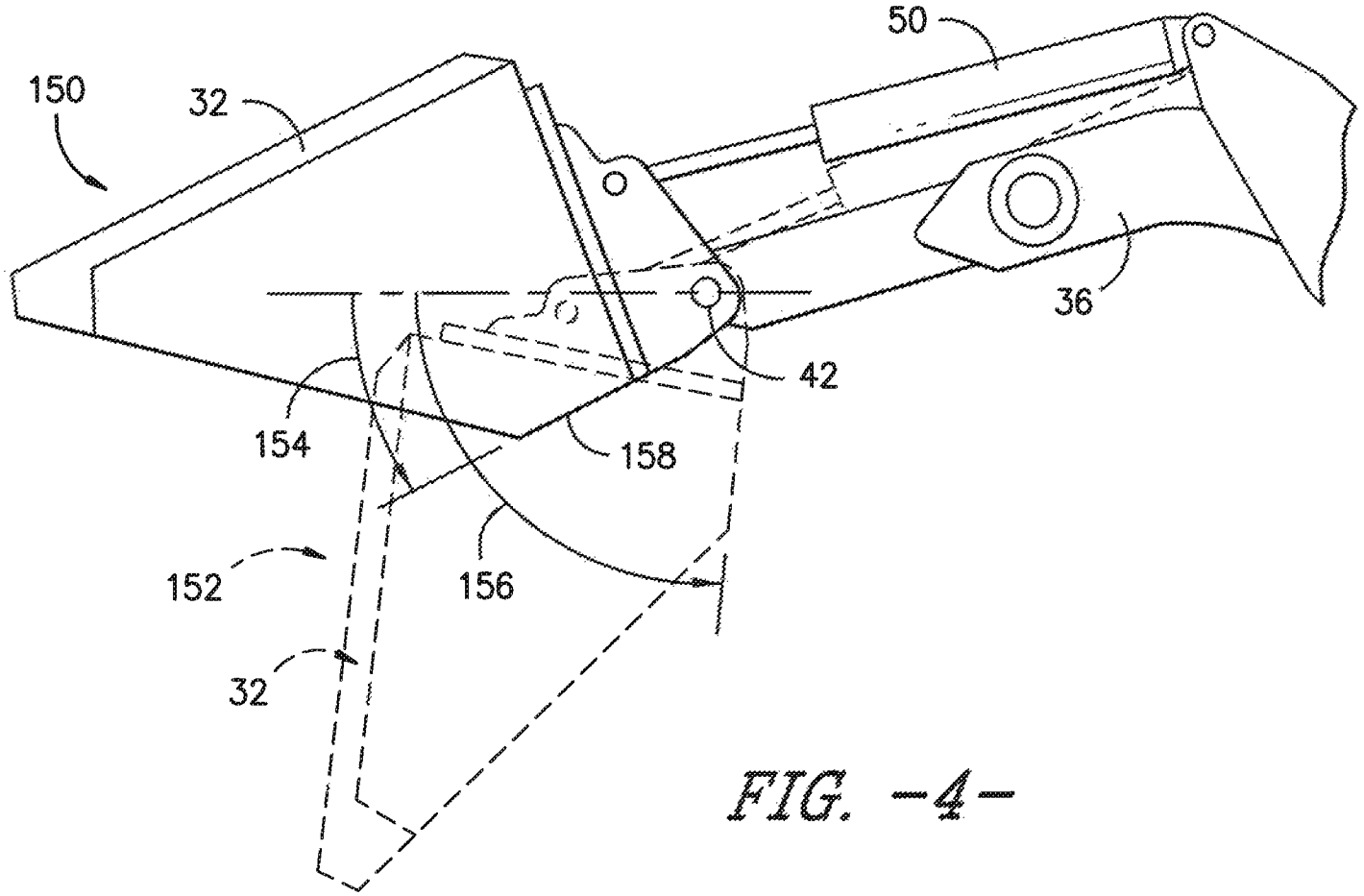
FIG. 4 illustrates a side view of one embodiment of an implement of the work vehicle shown in FIG. 1, particularly illustrating two different pre-defined positons for the implement that may be stored within a vehicle controller.

Referring now to FIGS. 3 and 4, several examples of pre-defined position settings of the loader arm(s) 36 and the implement 32 are illustrated in accordance with aspects of the present disclosure. Specifically, FIG. 3 illustrates two different position settings for the loader arm(s) 36 and FIG. 4 illustrates two different position settings for the implement 32.

As shown in FIG. 3, in one embodiment, the controller 102 may include a first loader position 140 (indicated by the solid lines) and a second loader position 142 (indicated by the dashed lines) stored within its memory 106 corresponding to pre-defined position settings for the loader arm(s) 36. Specifically, as shown in the illustrated embodiment, a reference point defined on the loader arm(s) 36 (e.g., the forward pivot point 42) may be located at a first height 144 above the vehicle's driving surface 34 when the loader arm(s) 36 are moved to the first loader position 140 and at a second height 146 above the vehicle's driving surface 34 when the loader arm(s) 36 are moved to the second loader position 142. In such an embodiment, the first height 144 may be selected, for example, such that the forward pivot point 42 is located generally adjacent to the vehicle's driving surface 34, thereby providing a suitable loader arm position (e.g., a return-to-travel position) when it is desired to move the work vehicle 10 along the driving surface 34 at a relatively high speed. Similarly, as shown in FIG. 3, the second height 146 may be selected, for example, such that the forward pivot point 42 is spaced apart significantly from the vehicle's driving surface 34, thereby providing a suitable loader arm position (e.g., a return-to-height position) when performing vehicle operations that require increased loader arm height (e.g., when dumping material into a truck bed).

It should be appreciated that the specific loader arm positions 140, 142 shown in FIG. 3 are simply provided as examples of suitable positions that may be stored within the controller's memory 106 as pre-defined loader arm position settings. In other embodiments, the first and second heights 144, 146 may be selected such that the forward pivot point 42 is located at any other suitable height relative to the vehicle's driving surface 34 when the loader arm(s) 36 are moved to each respective position 140, 142. Additionally, it should be appreciated that, although two loader arm positions 140, 142 are shown in FIG. 3, any number of pre-defined loader positon settings may be stored within the controller's memory 106, such as a single position setting or three or more position settings.

Similarly, as shown in FIG. 4, in one embodiment, the controller 102 may include a first implement position 150 (indicated by the solid lines) and a second implement position 152 (indicated by the dashed lines) stored within its memory 106 corresponding to pre-defined position settings for the vehicle's implement 32. Specifically, as shown in the illustrated embodiment, the implement 32 may be oriented at a given angular orientation when moved to the first implement position 150 so as to define a first angle 154 relative to parallel (or relative to the vehicle's driving surface 34). Additionally, the implement 32 may be oriented at a different angular orientation when moved to the second implement position 152 so as to define a second angle 156 relative to parallel (or relative to the vehicle's driving surface 34). In such an embodiment, the first angle 154 may be selected, for example, such that the implement 32 is oriented at a desirable position (e.g., a return-to-dig position) relative to the vehicle's driving surface 34 for performing a digging or scooping operation. More specifically, in certain embodiments, in the return-to-dig position, the teeth of the implement 32 may be positioned in a forward position (e.g. as shown via the first loader position 140 of FIG. 3).

Similarly, as shown in FIG. 4, the second angle 156 may be selected, for example, such that the implement 32 is oriented at a desirable position (e.g., a return-to-clump position) relative to the vehicle's driving surface 34 for performing a dumping operation. It should be appreciated that, in the illustrated embodiment, the angles 154, 156 associated with the angular orientation of the implement 32 have been defined relative to a bottom, planar surface 158 of the implement 32. However, in other embodiments, the angular orientation of the implement 32 may be defined relative to any other reference point on the implement 32.

It should be appreciated that the specific implement positions 150, 152 shown in FIG. 4 are simply provided as examples of suitable positions that may be stored within the controller's memory 106 as predefined implement position settings. In other embodiments, the angular orientations associated with the first and second angles 154, 156 may be selected such that the implement 32 is positioned at any other suitable orientation relative to the vehicle's driving surface 32 when it is moved to each respective implement position 150, 152. Additionally, it should be appreciated that, although two implement positions 150, 152 are shown in FIG. 4, any number of pre-defined implement positon settings may be stored within the controller's memory 106, such as a single position setting or three or more position settings.

As indicated above, in several embodiments, the controller 102 may be configured to control the operation of the various hydraulic components of the lift assembly 30 such that the loader arm(s) 36 and/or the implement 32 are moved to their respective return positions upon the receipt of an operator input selecting such position. In doing so, the manner in which the hydraulic components are commanded to operate may vary depending on the position of the loader arm(s) 36 and/or the implement 32 relative to the operator-selected position.

Figure 5:
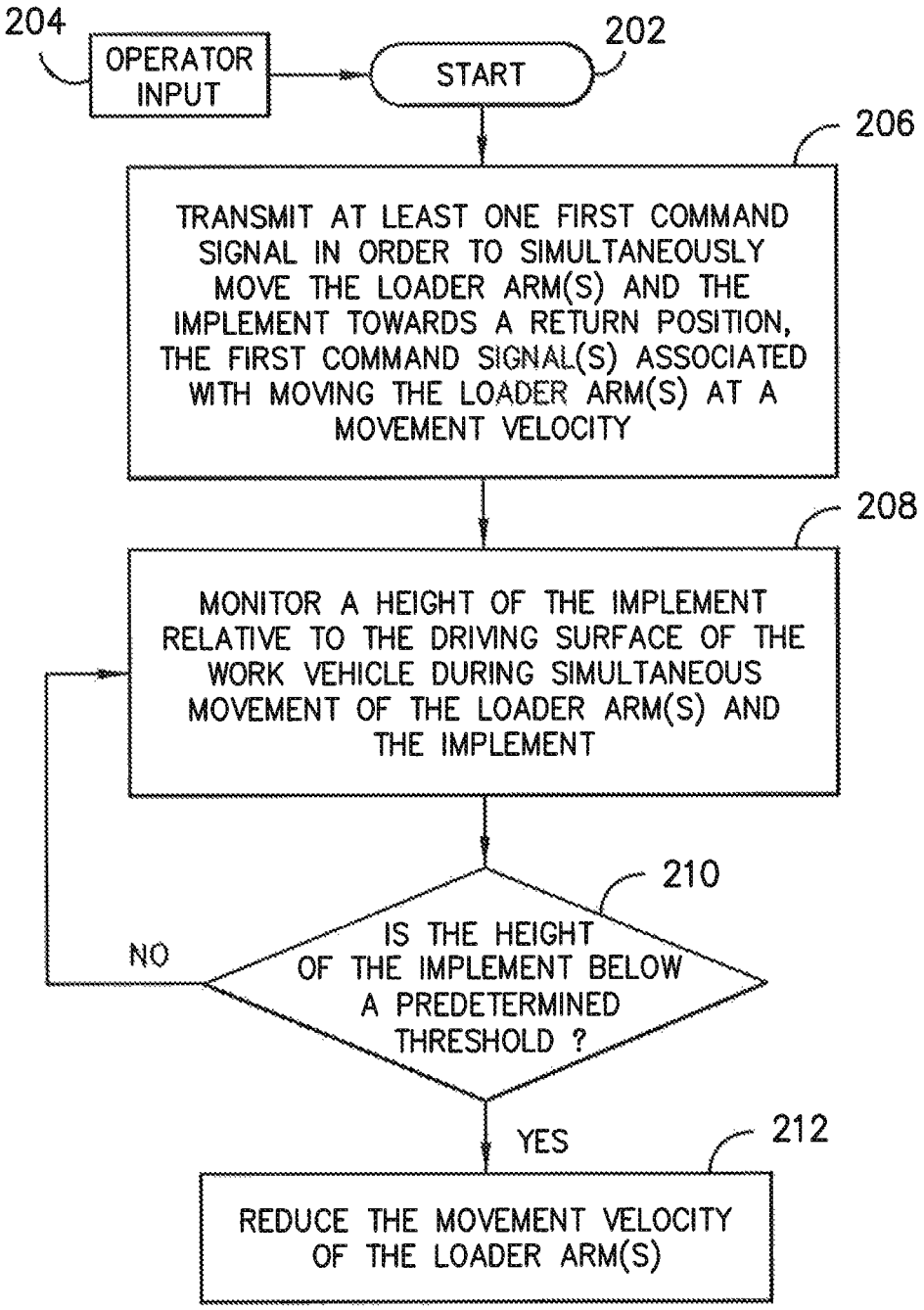
FIG. 5 illustrates a flow diagram of one embodiment of a control algorithm that may be utilized in accordance with aspects of the present disclosure to control the operation of a lift assembly of a work vehicle.

Referring now to FIG. 5, one embodiment of a control method 200 that may be utilized by a vehicle controller to implement the control strategies described above is illustrated in accordance with aspects of the present disclosure. In general, the method 200 will be described herein with reference to implementing a control algorithm to control the operation of the lift assembly 30 of the work vehicle 10. It should also be appreciated that, in instances in which the operator has commanded that the controller 102 simultaneously move both the loader arm(s) 36 and the implement 32 to their respective return positions, the control algorithm shown in FIG. 5 may be implemented simultaneously (but separately) for the loader arm(s) 36 and the implement 32. For example, in the illustrated example, the operator has commanded the controller 102 to simultaneously move the loader arm(s) 36 and the implement 32 to their respective return positions, which includes the loader arm(s) 36 being positioned at the return-to-travel position and the implement 32 being positioned at the return-to-dig position as described herein.

Thus, as shown at 202, the algorithm may be initiated upon the receipt of a suitable operator input 204 manually instructing the controller 102 to move the loader arm(s) 36 and the implement 32 to their return positions. In general, the human-machine interface for the work vehicle 10 may be designed such that the operator may utilize any suitable input device(s) 130 and/or perform any suitable action(s) to generate the operator input 204 for initiating the algorithm. However, in a particular embodiment of the present disclosure, the operator may initially instruct the controller 102 to go into the return position (e.g., by providing an operator input using one of the joysticks 24, 25, buttons, switches or other suitable input device(s) 130 housed within the cab 20). In alternative embodiments, the controller 102 may automatically receive the input associated with the instruction to move the loader arm(s) 36 and the implement 32 to the return position.

Referring still to FIG. 5, upon initiation of the algorithm, the controller 102 may, as shown at 206, be configured to transmit at least one first command signal in order to simultaneously move the loader arm(s) 36 and the implement 32 towards their respective return positions. More specifically, in certain embodiments, the first command signal(s) may be associated with moving the loader arm(s) 36 at a movement velocity.

Further, as shown at 208, the controller 102 may be configured to monitor a height of the implement 32 relative to the driving surface 34 of the vehicle 10 (e.g. the ground) during simultaneous movement of the loader arm(s) 36 and the implement 32. As shown at 210, the controller 102 determines whether the height is below a predetermined threshold. If so, then the implement 32 is at risk for contacting the ground, thereby causing damage to the ground and/or the work vehicle 10. Thus, as shown at 212, the controller 102 may be configured to reduce the movement velocity of the loader arm(s) 36 when the height is below the predetermined threshold. More specifically, in one embodiment, the controller 102 may transmit at least one second command signal in order to ramp down the movement velocity of the loader arm(s) 36 when the height 146 is below the predetermined threshold. By allowing the loader arm(s) 36 to move at a reduced speed (rather than stopping the loader arm(s) 36 altogether until the implement 32 is clear of the ground), the operator has a lower risk of surprising personnel near the work vehicle 10 with unexpected circuit movement.

For example, in certain embodiments, the controller 102 may be configured to reduce the movement velocity of the loader arm(s) 36 by a fixed percentage when the height 146 is below the predetermined threshold. In such embodiments, the second command signal(s) may be associated with a ramp-down percentage for the movement velocity of the loader arm(s) 36. In alternative embodiments, the controller 102 may be configured to reduce the movement velocity of the loader arm(s) 36 when the height is below the predetermined threshold as a function of the height 146. In additional embodiments, the controller 102 may be configured to maintain a movement velocity of the implement 32 such that the speed of the implement 32 does not change throughout the control method.

In further embodiments, the predetermined threshold may range from about 40% to about 70% of a length of the loader arm(s) 36. For example, in one embodiment, if the height 146 of the implement 32 drops below 40% of the length of one of the loader arm(s) 36, the controller 102 is configured to reduce the movement velocity of the loader arm 36.

It should be appreciated that the velocity of the loader arm(s) 36 may be monitored using any suitable speed sensor(s) configured to directly monitor the speed of the loader arm(s) 36 and/or using any other suitable sensor(s) that allows for such velocity to be indirectly monitored. For instance, as indicated above, the controller 102 may be communicatively coupled to one or more position sensors 132 for monitoring the position of the loader arm(s) 36. In such instance, by monitoring the change in position of the loader arm(s) 36 over time, the movement velocity of the loader arm(s) 36 may be estimated or calculated. For example, if the position sensor(s) 132 provides measurement signals corresponding to the position of the loader arm(s) 36 at a given sampling frequency (e.g., every 100 milliseconds), the movement velocity of the loader arm(s) 36 may be calculated by determining the change in position of the loader arm(s) 36 between the last two position measurements and by dividing the difference by the time interval existing between such measurements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling the operation of a lift assembly of a work vehicle, the lift assembly comprising an implement and at least one loader arm coupled to the implement, the method comprising:

transmitting, with a computing device, at least one first command signal in order to move the loader arm towards a loader arm return position, the at least one first command signal associated with moving the loader arms at a loader arm movement velocity;

transmitting, with the computing device, at least one second command signal in order to move the implement towards an implement return position simultaneous with the movement of the loader arm towards the loader arm return position, the at least one second command signal associated with moving the implement at an implement movement velocity;

monitoring, with the computing device, a height of the implement relative to a driving surface of the work vehicle during simultaneous movement of the loader arm and the implement; and when the height of the implement relative to the driving surface falls below a predetermined threshold, automatically reducing, with the computing device, the loader arm movement velocity of the loader arm as the loader arm continues to be moved towards the loader arm return position while maintaining the implement movement velocity as the implement continues to be moved towards the implement return position.

2. The method of claim 1, wherein the loader arm return position comprises a return-to-travel position for the loader arm and the implement return position comprises a return-to-dig position for the implement.

3. The method of claim 2, wherein teeth of the implement point towards a forward direction of travel of the work vehicle when the implement is at the return-to-dig position.

4. The method of claim 1, wherein transmitting the at least one first and second command signals comprises transmitting the at least one first and second command signals in response to an input associated with an instruction to simultaneously move the loader arm and the implement to the loader arm return position and the implement return position, respectively.

5. The method of claim 4, further comprising receiving the input associated with the instruction to simultaneously move the loader arm and the implement from an input device of the work vehicle.

6. The method of claim 5, wherein the input device comprises at least one of a joystick, a switch, or a button.

7. The method of claim 1, wherein automatically reducing the loader arm movement velocity comprises automatically reducing the loader arm movement velocity by a fixed percentage when the height of the implement is below the predetermined threshold.

8. The method of claim 1, wherein automatically reducing the loader arm movement velocity comprises automatically reducing the loader arm movement velocity as a function of the height of the implement when the height of the implement is below the predetermined threshold.

9. The method of claim 1, wherein the predetermined threshold ranges from about 40% to about 70% of a length of the loader arm.

10. A control system for operating a lift assembly of a work vehicle, the lift assembly comprising an implement and at least one loader arm coupled to the implement, the control system comprising:

one or more sensors configured to provide sensor data associated with a height of the implement relative to a driving surface of the work vehicle;

a controller communicatively coupled to the one or more sensors, the controller comprising one or more processors, the one or more processors configured to perform one or more operations, comprising:

transmitting at least one first command signal in order to move the loader arm towards a loader arm return position, the at least one first command signal associated with moving the loader arms at a loader arm movement velocity;

transmitting at least one second command signal in order to move the implement towards an implement return position simultaneous with the movement of the loader arm towards the loader arm return position, the at least one second command signal associated with moving the implement at an implement movement velocity;

monitoring the height of the implement relative to driving surface of the work vehicle during simultaneous movement of the loader arm and the implement based on the sensor data received from the one or more sensors; and when the height of the implement relative to the driving surface falls below a predetermined threshold, automatically reducing the loader arm movement velocity of the loader arm as the loader arm continues to be moved towards the loader arm return position while maintaining the implement movement velocity as the implement continues to be moved towards the implement return position.

11. A method for controlling the operation of a lift assembly of a work vehicle, the lift assembly comprising an implement and at least one loader arm coupled to the implement, the method comprising:

receiving, with a computing device, an input associated with an instruction to move the loader arm to a loader arm return position and the implement to an implement return position;

transmitting, with the computing device, at least one first command signal in order to move the loader arm towards the loader arm return position, the at least one first command signal associated with moving the loader arms at a loader arm movement velocity;

transmitting, with the computing device, at least one second command signal in order to move the implement towards the implement return position simultaneous with the movement of the loader arm towards the loader arm return position, the at least one second command signal associated with moving the implement at an implement movement velocity;

monitoring, with the computing device, a height of the implement relative to a driving surface of the work vehicle during simultaneous movement of the loader arm and the implement; and when the height of the implement relative to the driving surface falls below a predetermined threshold, transmitting, with the computing device, at least one third command signal in order to ramp down the loader arm movement velocity of the loader arm as the loader arm continues to be moved towards the loader arm return position while maintaining the implement movement velocity as the implement continues to be moved towards the implement return position.

12. The method of claim 11, wherein the loader arm return position comprises a return-to-travel position for the loader arm and the implement return position comprises a return-to-dig position for the implement.

13. The method of claim 12, wherein teeth of the implement point towards a forward direction of travel of the work vehicle when the implement is at the return-to-dig position.

14. The method of claim 11, wherein transmitting the at least one third command signal in order to ramp down the loader arm movement velocity comprises transmitting the at least one third command signal in order to reduce the loader arm movement velocity by a fixed percentage.

15. The method of claim 11, wherein transmitting the at least one third command signal in order to ramp down the loader arm movement velocity comprises transmitting the at least one third command signal in order to reduce the loader arm movement velocity as a function of the height of the implement.

* * * * *